US005421268A

United States Patent [19]

Roberts et al.

[11] Patent Number: 5,421,268

[45] Date of Patent: Jun. 6, 1995

[54] CONVEYING SYSTEM

[75] Inventors: Charles Roberts; Donald Swallow, both of Evansville; Randall Wire, Boonville, all of Ind.

[73] Assignee: Evana Automation, Evansville, Ind.

[21] Appl. No.: 153,036

[22] Filed: Nov. 17, 1993

[51] Int. Cl.[6] ..... B61C 7/00

[52] U.S. Cl. ..... 105/26.05; 105/30; 105/32; 105/33; 105/141; 105/144

[58] Field of Search ..... 105/26.05, 26.1, 29.1, 105/29.2, 30, 31, 32, 33, 141, 144; 104/165, 166, 306, 307

[56] References Cited

U.S. PATENT DOCUMENTS

| | | | |
|---|---|---|---|
| 3,118,393 | 1/1961 | Ohlin | 104/166 |
| 3,356,040 | 12/1965 | Fonden | 104/166 |
| 3,811,384 | 5/1974 | Brown | 104/306 |
| 3,858,626 | 1/1975 | Ribordy | 104/166 |
| 3,858,707 | 1/1975 | Block et al. | 198/19 |
| 3,911,827 | 10/1975 | Jarnaker | 105/29.1 |
| 4,023,503 | 5/1977 | Grop | 105/30 |
| 4,355,581 | 10/1982 | Mitani | 104/166 |
| 4,487,132 | 12/1984 | Fuchs et al. | 104/166 |
| 4,974,519 | 12/1990 | Miletto | 104/165 |

FOREIGN PATENT DOCUMENTS

| | | | |
|---|---|---|---|
| 0663134 | 7/1938 | Germany | 104/306 |
| 2544072 | 4/1976 | Germany | 105/30 |
| 4339073 | 11/1992 | Japan | 104/306 |

*Primary Examiner*—Mark T. Le
*Attorney, Agent, or Firm*—Larson & Taylor

[57] ABSTRACT

A conveying system is provided for moving a pallet along straight and curved paths. The conveying system includes a track on which the pallet is mounted for movement by means of a motor driven roller pivotally mounted on the pallet which engages a stationary shaft mounted on the track. Depending on the position of the drive roller in relation to the shaft, the pallet is driven forward, rearward, or remains stationary. The drive roller is resiliently urged into contact with the shaft and is pivotally mounted on the pallet so as to be movable between a forward drive position, a rearward drive position, and a stationary position. A resilient bias urges the drive roller to the forward drive position. A cam mechanism is provided to move the drive roller to the stationary position when desired.

10 Claims, 3 Drawing Sheets

CONVEYING SYSTEM

FIELD OF THE INVENTION

The present invention relates generally to a conveying system which moves a pallet along straight and curved paths, and more particularly to a conveying system in which propulsion for the pallet is provided by a rotating drive roller in contact with a stationary shaft.

BACKGROUND OF THE INVENTION

Conveying systems utilizing a rotating drive shaft and a contacting drive wheel have been disclosed in the prior art. Typical of such devices are those disclosed in the following U.S. Pat. Nos. 3,356,040 (Fonden); 3,118,393 (Ohlin); 3,858,626 (Ribordy); 3,858,707 (Block et al); and 4,487,132 (Fuchs et al).

While this type of conveying system is workable for straightline motion of a pallet, the requirement in these systems for a rotating shaft precludes curvilinear motion of the pallet. Also, independent movement of several pallets along the same shaft cannot be as simply achieved with these systems as with the present invention.

SUMMARY OF THE INVENTION

In accordance with the present invention there is provided a conveying system which includes a track with pallets movable along the track. A stationary shaft is mounted adjacent to the track and a drive roller mounted on the pallet is in contact with the shaft. The drive roller is rotatable about a central axis and has an axial face engaging the stationary shaft. The pallet is propelled along the track by a motor mounted on the pallet which rotates the drive roller. Because the shaft is stationary, the pallet is capable of motion along both straight and curved tracks, unlike other conveying systems which use a rotating shaft and are limited to straightline motion.

In the preferred embodiment of the present invention, the drive roller is resiliently urged into contact with the shaft. The drive roller and motor are pivotally attached to the pallet so that the drive roller may be movable between a forward drive position and a rearward drive position, with a neutral position in the middle. Preferably, biasing means is also provided for resiliently urging the drive roller into the forward drive position. A cam means is also provided so that engagement with a cam surface positioned along the track pivots the drive roller to the neutral position to stop the pallet at a desired location.

Other features and advantages of the present invention are readily apparent from the detailed description of the presently preferred embodiment of the invention set forth hereinafter.

DETAILED DESCRIPTION OF THE PREFERRED EMBODIMENT

Figure 1:
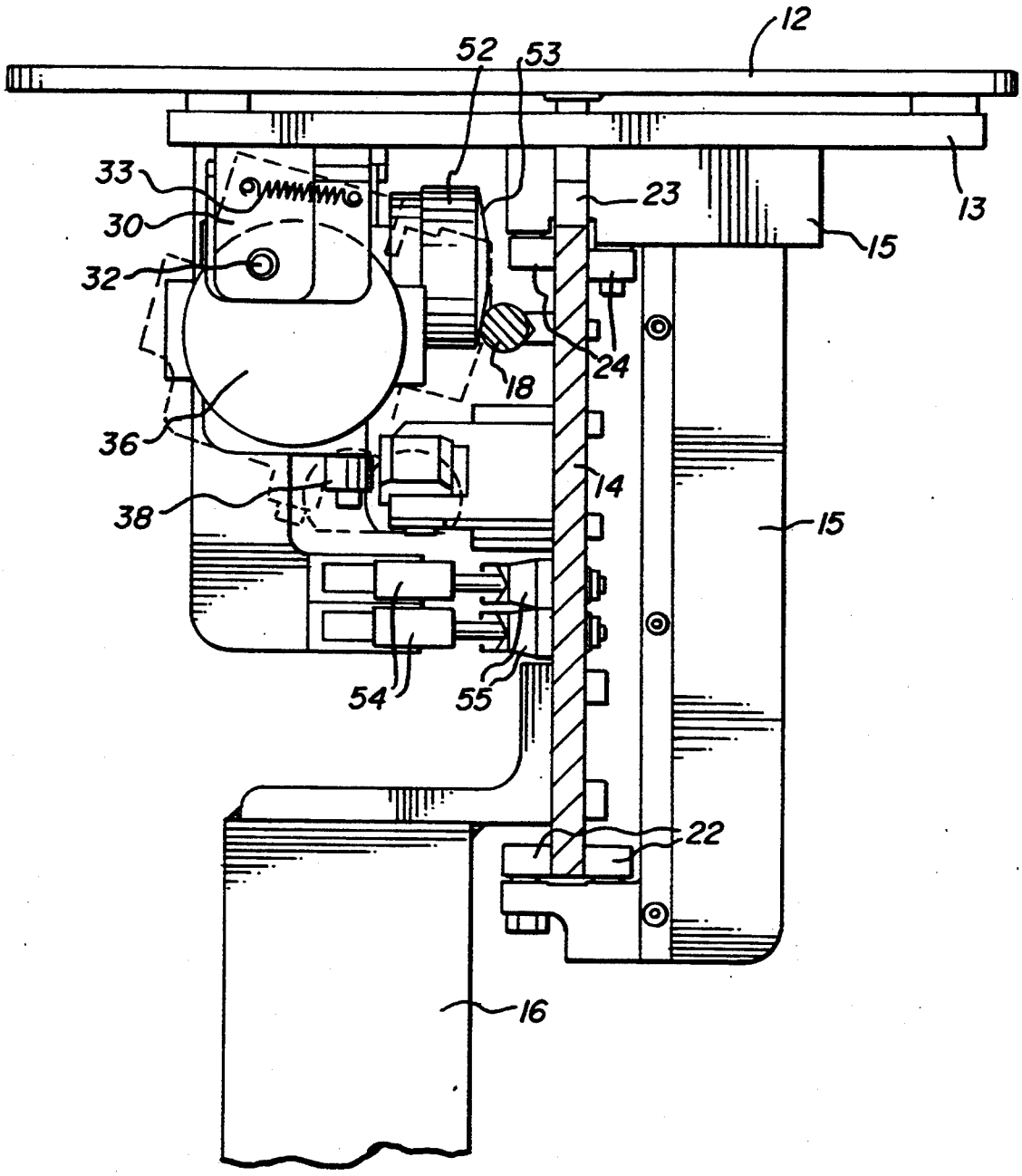
FIG. 1 is a front elevation view of a conveying system according to the present invention.

With reference to the drawings wherein like numerals refer to like elements throughout the several views, there is provided a conveying system 10 for moving pallets 12 along a track 14. The track is supported by vertical support plates 16. The track 14 may be in a straight line or curved in any desired pattern. The pallet 12 is supported on a plate 13. The pallet 12 may be rotatable on the plate 13 so that ready access is provided to any part of an article resting on the pallet. A bracket 15 is secured to the bottom surface of the plate 13. The lower end of the bracket 15 has rotatably mounted thereon a pair of rollers 22 which engage opposite faces of the lower end of track 14. The upper end of bracket 15 has rotatably mounted thereon a single roller 23 which rolls on the upper end of the track 14. A pair of rollers 24 are rotatable on the opposite faces of the upper end of the track 14. The supporting structure of the pallet 12 provides for a firm relatively friction free ride on track 14.

Located on one side of the track 14 is a shaft 18 which is secured to the track and which conforms to any curvature in the path of the track 14. The shaft is cylindrical as shown but may be of any desired shape providing there is an outer surface appropriate to engage the surface of a driver roller 52 as described hereinafter.

Mounted on the lower face of plate 13 is a fixed brace 30. A pivot pin 32 is mounted in fixed brace 30. A motor 36 is mounted on pivot pin 32. A drive roller 52, which may be of a polyurethane material, is mounted on the drive shaft (not shown) of motor 36. A spring 33 retains the roller 52 in the full line position with the axial face 53 of the roller held firmly against stationary shaft 18, preferably with less than 50 pounds of force. The motor 36 and roller 52 may be rotated about pivot 32 so as to extend spring 33 and allow for positioning of the roller 52 as shown in the dotted line position. In this position the shaft 18 engages only the center of the axial face 53 so that the pallet will remain in a stationary or neutral position. With the drive roller 52 in the full line position as shown in FIG. 1 the pallet will be driven along the track in a forward direction and, when the motor 36 and roller 52 are pivoted to a full extension of the spring 33 with the upper portion of the axial face 53 of the roller in contact with the shaft 18, the pallet will be driven in a rearward direction. Axial face 53 of drive roller 52 may have a flat, convex, or elliptical shape, or any other shape adapted to provide frictional contact between roller 52 and shaft 18 to effectively propel pallet 12 along shaft 18. Bus bar contacts 54 are slidably disposed within bus bar guides 55 fixed to the track 14, and electrical energy is conducted from bus bar guides 55 through bus bar contacts 54 to motor 36 to provide energy for rotational motion of drive roller 52.

Figure 2:
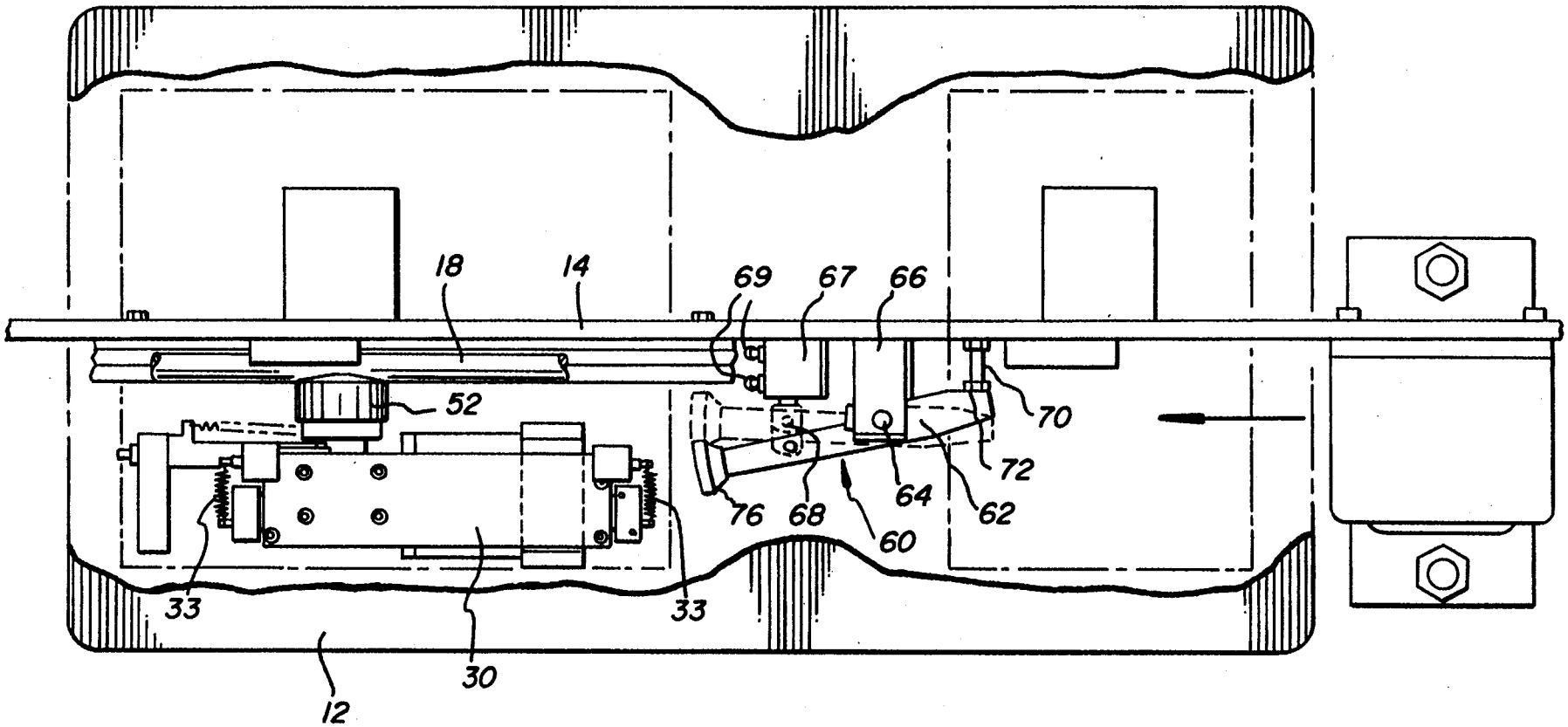
FIG. 2 is a top plan view of a conveying system according to the present invention.
Figure 3:
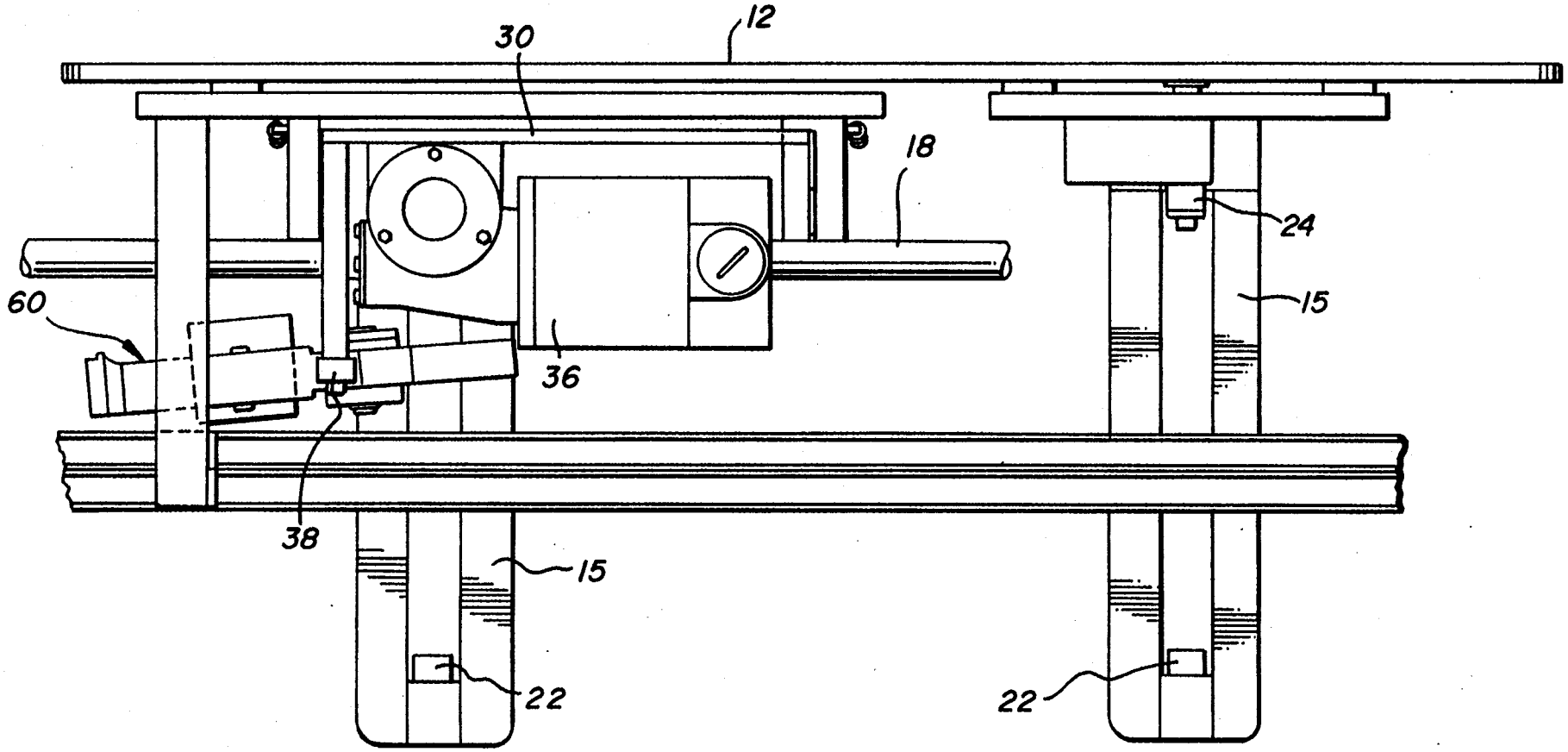
FIG. 3 is a side elevation view of a conveying system according to the present invention.

Pallet stopping means 60, FIG. 2, provides a mechanism to stop the forward motion of a pallet, for example, to allow a factory worker to perform some type of assembly operation on a workpiece supported on the pallet. Elongate member 62 is pivotally attached to track 14 about pivot 64 on pivot support 66 which is fixed to track 14. Arm 68 extends from a pneumatic cylinder 67 to extend or retract member 62. Pneumatic inlets 69 provide pneumatic energy to pneumatic cylinder 67 to selectively extend or retract retractable member 68.

When retractable member 68 is extended elongate member 62 is pivoted to a position where pivot stop surface 72 contacts the surface of pivot stop 70. When elongate member 62 is pivoted to this position, as shown in the full lines in FIG. 2, and as a pallet 12 approaches pallet stopping means 60 as shown by the arrow, cam follower 38 mounted on motor 36 as shown in FIG. 1, engages with the cam-engaging surface of elongate member 62. Thus, cam follower 38 is urged away from track 14, and causing motor 36 to pivot about pivot 32 until drive roller 52 has reached the neutral position, as shown by the dashed lines in FIG. 1. As momentum carries pallet 12 forward, cam follower 38 comes into contact with curved surface 76 of the end portion of member 62 further pivoting the motor 36 and causing drive roller 52 to momentarily rotate beyond the neutral position into the rearward position, thereby causing the pallet 12 to move in the rearward direction. Some oscillation occurs before the pallet 12 comes to rest in the neutral position; however, such oscillation is minimized by the damping effect of the curved surface 76 upon the motion of cam follower 38.

After the motion of the pallet 12 has been stopped by action of pallet stopping means 60, the pneumatic cylinder 67 may be activated to retract retractable member 68, thereby releasing cam follower 38 from the constraining action of the cam-engaging surface of elongate member 62, allowing the drive roller to return to the forward drive position by action of spring 33, so that the pallet resumes forward motion along track 14.

While the present invention has been described with respect to exemplary embodiments thereof, it will be understood by those of ordinary skill in the art that these and other variations and modifications can be affected within the scope and spirit of the invention.

We claim:

1. A conveying system for moving an object along a path comprising:

a pallet on which the object is conveyed;

a track for mounting said pallet for straightline and curvilinear movement along said track;

a shaft mounted on said track means;

a drive roller mounted on said pallet, said drive roller being rotatable about an axis and having an axial face;

means for rotating said drive roller about an axis of rotation;

mounting means for mounting said drive roller and said rotating means on said pallet such that the axial face of said drive roller contacts said shaft to drive said pallet along said track by the rotation of said drive roller;

resilient means for resiliently urging said drive roller into contact with said shaft; and said pivoting means including pivot means for pivotally attaching said drive roller and rotating means to said pallet such that said drive roller and rotating means is pivotable about an axis so that said drive roller is in contact with said shaft and is movable to a forward drive position wherein one side of said axial face is in contact with said shaft, a rearward drive position wherein the other side of said axial face is in contact with said shaft, and a neutral position wherein the center of said axial face is in contact with said shaft.

2. A conveying system as claimed in claim 1 wherein said resilient means urges said drive roller into contact with said shaft with less than 50 pounds of force.

3. A conveying system as claimed in claim 2 wherein said mounting means further includes a bias means for resiliently biasing said drive roller to the forward drive position.

4. A conveying system as claimed in claim 3 wherein said mounting means further includes a cam means for engaging a cam surface positioned adjacent to said track means and for pivoting said drive roller to the neutral position.

5. A conveying system as claimed in claim 4 wherein said cam surface is pivotable between a cam-engaging position to stop the motion of said pallet along said track and a non-engaging position to allow the continued motion of said pallet along said track.

6. A conveying system as claimed in claim 1 wherein said axial face is elliptically shaped.

7. A conveying system as claimed in claim 1 and further including bus bars on said mounting means and slidably engaged within bus bar guides mounted on said track to convey electrical energy from said bus bar guides to said drive roller rotating means.

8. A conveying system as claimed in claim 1 wherein said mounting means includes rollers disposed between said pallet and said track.

9. A conveying system as claimed in claim 1 wherein said drive roller is made of a polyurethane material.

10. A conveying system as claimed in claim 1 wherein said shaft is cylindrically shaped.

* * * * *